US006386238B1

(12) United States Patent
Hestetune

(10) Patent No.: US 6,386,238 B1
(45) Date of Patent: May 14, 2002

(54) METHODS AND APPARATUS FOR DETANGLING COILED HOSES AND SPRINGS

(75) Inventor: James Brown Hestetune, Burlington, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,245

(22) Filed: Aug. 9, 2001

(51) Int. Cl.[7] ..... F16L 57/00
(52) U.S. Cl. ..... 138/110; 138/118.1
(58) Field of Search ..... 138/110, 118.1, 138/103, 118, 962, 98

(56) References Cited

U.S. PATENT DOCUMENTS 3,587,654 A * 6/1971 Yocum ..... 138/89
3,920,050 A * 11/1975 Nichol et al. ..... 138/110
4,009,734 A * 3/1977 Sullivan ..... 138/177
4,846,794 A * 7/1989 Hertzer ..... 604/83
5,027,862 A * 7/1991 Laybourn ..... 138/99
5,111,849 A * 5/1992 Zeh ..... 138/118
5,232,645 A * 8/1993 Ramos, Jr. ..... 138/125
5,309,585 A * 5/1994 Hochschild, III ..... 138/110 X
5,369,823 A * 12/1994 Hochschild, III ..... 138/110 X
5,687,773 A * 11/1997 Ryan et al. ..... 138/96 R
6,032,697 A * 3/2000 Kennedy ..... 138/96 R
6,102,076 A * 8/2000 Romero, Jr. et al. ..... 138/96 R

* cited by examiner

*Primary Examiner*—Patrick Brinson
(74) *Attorney, Agent, or Firm*—Karl Vick, Esq.; Damian Wasserbauer, Esq.; Armstrong Teasdale LLP

(57) ABSTRACT

During coiled hose and spring operations, a sheath reduces entanglements within a workstation and provides unrestricted access to manufacturing and assembly line pneumatic tools and equipment. The sheath includes a first end, a second end, and a body extending therebetween. The first and second ends are secured to a coiled device. The body defines a cavity sized to receive a portion of the coiled device therein. The sheath installs easily, is reliable, and is resilient to entanglements induced by coiled devices.

19 Claims, 2 Drawing Sheets

METHODS AND APPARATUS FOR DETANGLING COILED HOSES AND SPRINGS

BACKGROUND OF INVENTION

This invention relates generally to coiled devices, and more specifically, to methods and apparatus for preventing tangling of coiled devices.

Manufacturing and assembly lines include workstations equipped with multiple air tools. A length and diameter of each associated air hose varies depending upon each specific application and workstation. To facilitate centralized storage, at least some known air hoses are biased to remain coiled. Such a spring-like bias may cause adjacent air hoses stored in close proximity to become entangled. A risk of entanglement is increased when devices attached to coiled springs are also stored in close proximity to the air hoses.

When air hoses become entangled, their ability to stretch at a workstation may diminish significantly. More specifically, tangled air hoses may require time-consuming detangling prior to being used. Furthermore, pulling a tangled air hose may cause an adjacent air hose to move and cause a tool attached to such an air hose to inadvertently fall. Following a fall, a tool may require repair or calibration before being returned to service. As a result, assembly costs may be increased.

SUMMARY OF INVENTION

In one aspect of the invention, a sheath for a coiled device is provided. The stealth includes a first end, a second end, and a body extending therebetween, the first and second ends are configured to be secured to the coiled device. The body defines a cavity sized to receive a portion of the coiled device therein. The sheath is configured to facilitate reducing tangling of the coiled device.

In another aspect of the invention, a coiled device assembly including a coiled device and a sheath is provided. The sheath comprises a body, a first end, a second end, and a bore extending therebetween. The first and second ends are configured to be coupled to a coiled device. At least one of the ends is selectively adjustable.

In a further aspect of the invention, a method of storing a coiled device to facilitate reducing tangling of a coiled devices includes providing a sheath including a first end and a second end. The method further includes coupling the first end and the second end of the sheath to the coiled device such that the coiled device is at least partially positioned within a cavity defined between the sheath first and second ends.

DETAILED DESCRIPTION

Figure 1:
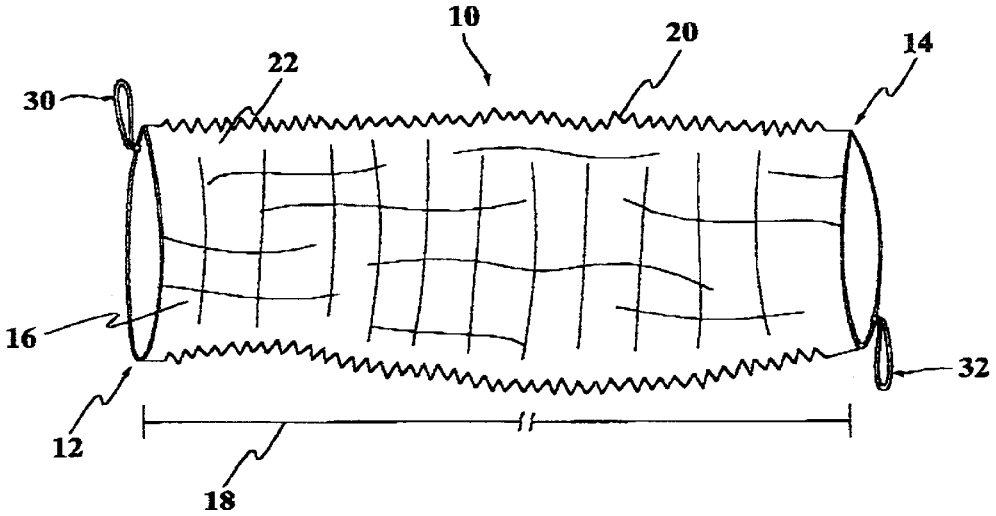
FIG. 1 is a side view of a sheath including a fastening device.

FIG. 1 is a side view of a sheath 10 including a first end 12, a second end 14, and an expandable body 16 extending therebetween. In one embodiment, body 16 is manufactured from a flexible material and stretches to accommodate the elongation of a coiled device (not shown in FIG. 1). Sheath

10 has a length 18 that is measured between first and second ends 12 and 14, respectively. More specifically, because body 16 is expandable, sheath length 18 is variable and extends between a contracted position 20, as illustrated in FIG. 1, and a fully extended position (not shown in FIG. 1). In one embodiment, when sheath 10 is in contracted position 20, an outer surface 22 of body 16 comprises a substantially contracted configuration. Alternatively, when sheath 10 has been expanded, depending on an amount of expansion, body outer surface 22 may be substantially non-contracted between first and second end 12 and 14, respectively.

In the exemplary embodiment, sheath body 16 is substantially tubular, and first and second ends 12 and 14, respectively, are identical. In an alternative embodiment, sheath body 16 is non-tubular. In further embodiment, first end 12 and second end 14 are substantially different.

Sheath first and second ends 12 and 14, respectively, each include a fastener device 30 and 32 used to secure sheath 10 to a coiled device(not shown in FIG. 1). In one embodiment, fastener devices 30 and 32 are identical. Alternatively, fastener device 30 is not identical with fastener device 32. In the exemplary embodiment, fastener devices 30 and 32 are drawstring fasteners. Alternatively, any other suitable fastening device or securing device may be used which permits first end 12 and second end 14 to remain coupled to a coiled device (not shown in FIG. 1), such as but not limited to, mechanical devices, interlocking devices, hook and pile fasteners, hook and loop fasteners, tab and slot devices, locking mechanisms, magnets, tying systems, or clips.

Figure 2:
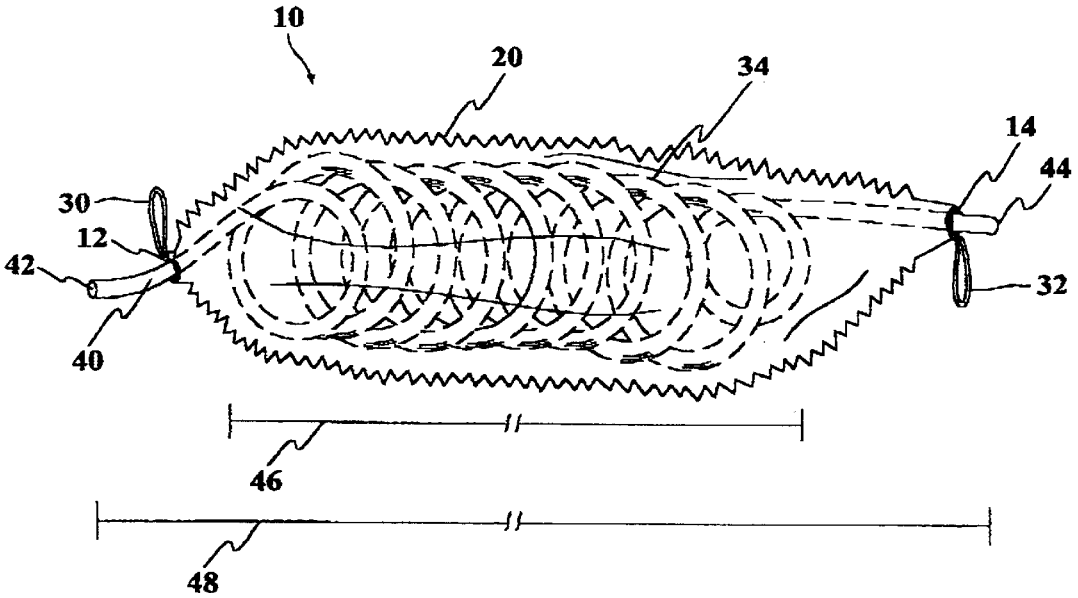
FIG. 2 is a side view of the sheath shown in FIG. 1 coupled to a coiled device in a contracted position.
Figure 3:
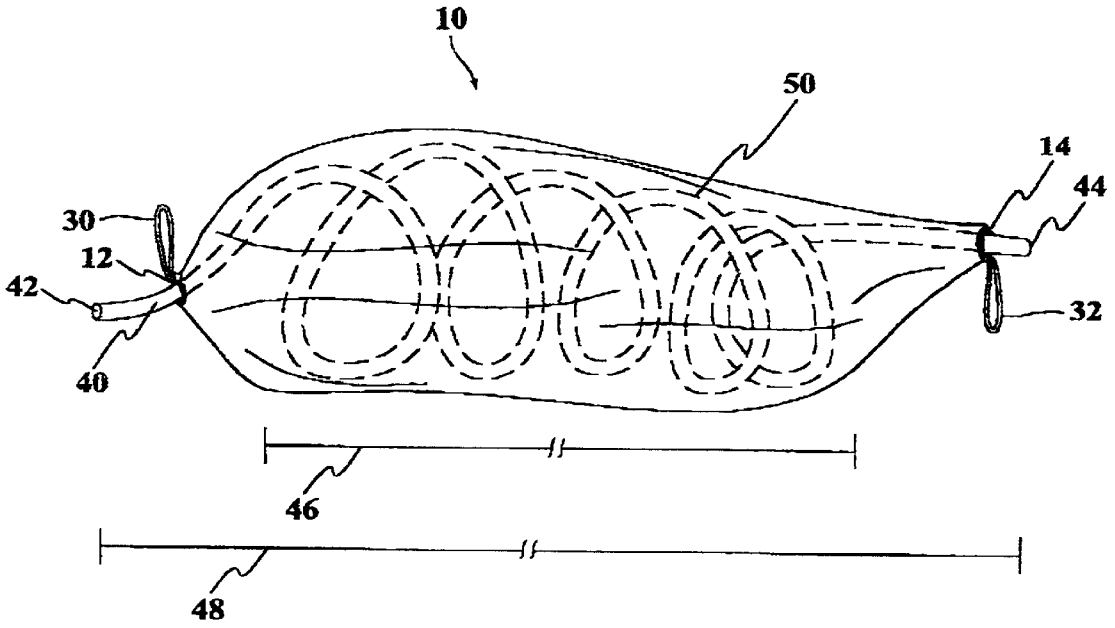
FIG. 3 is a side view of the sheath shown in FIG. 1 coupled to a coiled device in a fully-extended position.

FIG. 2 is a side view of sheath 10 coupled to a coiled device 40 in a contracted position 34. FIG. 3 is a side view of sheath 10 coupled to coiled device 40 in a fully extended position 50. Coiled device 40 includes a first end 42, a second end 44, and a flexibly coiled intermediate portion 46 extending therebetween and including a plurality of coils. Coiled device 40 has length 48 that is measured between first end 42 and second end 44, respectively. More specifically, because intermediate portion 46 is flexible, coiled device length 48 is variable and extends between a contracted position 34, and fully-extended position 50, as illustrated in FIG. 3 of coiled device 40. When coiled device 40 is in contracted position 34, sheath length 18 is equal to coiled device length 48 in contracted position 34 such that all of intermediate portion 46 is contained therein. Additionally, when sheath 10 is in fully extended position 50, sheath length 18 is equal to the coiled device length 48 in fully extended position 50 such that all of intermediate portion 46 is contained therein.

In one embodiment, coiled device 40 is a pneumatic air hose biased in a coiled configuration. In an alternative embodiment, coiled device 40 is a coil spring. Alternatively, any other coiled device may be housed within sheath 10, including, but not limited to phone handset cords, truck air brake hoses, or computer keyboard cords.

Fastening devices 30 and 32, respectively couple sheath 10 to coiled device 40 such that sheath 10 remains attached to coiled device first and seconds end 42 and 44, respectively while coiled device 40 is moved. In the exemplary embodiment, fastening devices 30 and 32, respectively couple sheath 10 to coiled device 40 such that the coiled middle portion 46 of coiled device 40 is contained therein and allows unrestricted movement of coiled device 40 therein.

Sheath 10 includes fasteners 30 and 32, respectively, which couple sheath 10 to coiled device 40. Fastening devices 30 and 32 maintain sheath 10 in a substantially mirrored state with coiled device 40. Accordingly, sheath 10 is utilized to facilitate reducing tangling of coiled device 40 with neighboring coiled devices (not shown). Coiled device 40 moves freely inside sheath 10. In one embodiment, sheath 10 is utilized to facilitate reducing tangling of coiled pneumatic air hoses during assembly line operations. In another embodiment, sheath 10 is utilized to facilitate reducing tangling of coiled springs during operation.

Alternatively, sheath 10 arrives to manufacturing and assembly lines secured to coiled device 40. This embodiment greatly reduces tangling at workstations.

While the invention has been described in terms of various specific embodiments, those skilled in the art will recognize that the invention can be practiced with modification within the spirit and scope of the claims.

What is claimed is:

1. A sheath for a coiled device, said sheath comprising:

a first end, a second end, and a body extending therebetween, said body comprising a continuous outer surface, said first end configured to be secured to the coiled device, said second end configured to be secured to the coiled device, said body defining a cavity sized to receive a portion of the coiled device therein, said sheath configured to facilitate reducing tangling of the coiled device.

2. A sheath in accordance with claim 1, wherein said sheath body is fabricated from a flexible material.

3. A sheath in accordance with claim 1 wherein said sheath body comprises an elongated tube configured to permit substantially unrestricted movement of the coiled device therein.

4. A sheath in accordance with claim 1 wherein the coiled device is at least one of an air hose, a cable, and a spring, said sheath configured to expand and contract in proportion to an amount of movement of the coiled device.

5. A sheath in accordance with claim 1 wherein said sheath first and second ends configured to be secured to the coiled device by at least one of a drawstring, a cord tie, and a strap.

6. A coiled device assembly comprising:

a coiled device; and a sheath comprising a sheath body, a first end, a second end, and a bore extending therebetween, said sheath body comprising a continuous outer surface extending between said sheath first and second ends, said first and second ends coupled to the coiled device, at least one of said first and second ends is selectively adjustable.

7. A coiled device assembly in accordance with claim 6 wherein said sheath body is fabricated from a pliable material.

8. A coiled device assembly in accordance with claim 6 wherein the coiled device is at least one of an air hose, a cable and a spring, said sheath configured to expand and contract in proportion to an amount of expansion and contraction of the coiled device.

9. A coiled device assembly in accordance with claim 6 wherein said sheath first and second ends configured to remain attached to the coiled device while the coiled device is moved.

10. A coiled device assembly in accordance with claim 6 wherein said sheath first and second ends secured to the coiled device by at least one of a drawstring, a cord tie, and a strap.

11. A coiled device assembly in accordance with claim 6 wherein at least one of said sheath first end and said second end is configured to be tightened circumferentially around the coiled device.

12. A coiled device assembly in accordance with claim 6 wherein at least one of said sheath first end and said second end has a fixed diameter.

13. A method of storing a coiled device to facilitate reducing tangling of the coiled device, said method comprising:

providing a sheath, including a first end and a second end, wherein the sheath has a continuous outer surface that extends between the first and second ends;

coupling the first end of the sheath to the coiled device; and coupling the second end of the sheath to the coiled device such that the coiled device is positioned at least partially within a cavity defined within the sheath between the sheath first and second ends.

14. A method in accordance with claim 13 wherein providing a sheath comprises providing a sheath fabricated from a flexible material.

15. A method in accordance with claim 13 wherein providing a sheath comprises providing a sheath including a cavity sized to substantially receive at least one of an air hose, a cable and a spring.

16. A method in accordance with claim 13 wherein providing a sheath comprises providing a sheath that expands and contracts in proportion to an amount of movement of the coiled device.

17. A method in accordance with claim 13 wherein coupling the second end comprises coupling the sheath to the coiled device, such that the coiled device is freely expandable and contractible.

18. A method in accordance with claim 17 wherein providing a device comprises providing a sheath including first and second ends that remain coupled to the coiled device during movement of the coiled device.

19. A method in accordance with claim 13 wherein providing a device comprises providing a sheath that is secured to the coiled device by at least one of a drawstring, a cord tie, and a strap.

* * * * *